US009498733B2

(12) United States Patent
Henrik

(10) Patent No.: US 9,498,733 B2
(45) Date of Patent: Nov. 22, 2016

(54) BALLOON WITH LIGHTING/SOUNDING DEVICE

(75) Inventor: Bo Stieler Henrik, Shenzhen (CN)

(73) Assignee: SHENZHEN PROMOTION CONCEPT CO. LTD., Shenzhen, Guangdong (CN)

( * ) Notice: Subject to any disclaimer, the term of this patent is extended or adjusted under 35 U.S.C. 154(b) by 0 days.

(21) Appl. No.: 14/351,577

(22) PCT Filed: Jan. 4, 2012

(86) PCT No.: PCT/CN2012/070043

§ 371 (c)(1),
(2), (4) Date: Apr. 14, 2014

(87) PCT Pub. No.: WO2013/053208

PCT Pub. Date: Apr. 18, 2013

(65) Prior Publication Data

US 2014/0235135 A1 Aug. 21, 2014

(30) Foreign Application Priority Data

Oct. 14, 2011 (CN) ..... 2011 1 0311576

(51) Int. Cl.
*A63H 27/10* (2006.01)
*F21V 3/02* (2006.01)

(52) U.S. Cl.
CPC ..... *A63H 27/10* (2013.01); *F21V 3/023* (2013.01); *A63H 2027/1058* (2013.01)

(58) Field of Classification Search
CPC ..... A63H 2027/1058; A63H 2027/1008; A63H 2027/1016; A63H 2027/1025; A63H 2027/1033; A63H 2027/1041; A63H 2027/105; A63H 2027/1066; A63H 2027/1075
USPC ..... 446/220–226
See application file for complete search history.

(56) References Cited

U.S. PATENT DOCUMENTS

| | | | | |
|---|---|---|---|---|
| 5,669,702 | A * | 9/1997 | Wang | 362/234 |
| 7,551,061 | B2 * | 6/2009 | Blackman | 340/384.6 |
| 8,297,778 | B2 * | 10/2012 | Jeffrey | 362/189 |
| 8,727,919 | B1 * | 5/2014 | Gentile | 473/570 |
| 2005/0269442 | A1 * | 12/2005 | Nguyen et al. | 244/31 |
| 2010/0041303 | A1 * | 2/2010 | Koonce et al. | 446/220 |
| 2012/0314406 | A1 * | 12/2012 | Halliburton | 362/191 |

* cited by examiner

*Primary Examiner* — Gene Kim
*Assistant Examiner* — Rayshun Peng

(57) ABSTRACT

A balloon with a lighting/sounding device includes a balloon body and a lighting/sounding device secured onto a wall of the balloon body, wherein the lighting/sounding device is secured onto the balloon wall via an external cover. The lighting/sounding device is secured via the external cover, which facilitates setting and installation of the lighting/sounding device and simplifies a configuration structure thereof so as to reduce manufacturing costs, and such a structure will not affect the inflation and use of the balloon but provides more convenient decoration and entertainment.

4 Claims, 6 Drawing Sheets

BALLOON WITH LIGHTING/SOUNDING DEVICE

CROSS REFERENCE OF RELATED APPLICATION

This is a U.S. National Stage under 35 U.S.C. 371 of the International Application PCT/CN2012/070043, filed Jan. 4, 2012, which claims priority under 35 U.S.C. 119(a-d) to CN 201110311576.6, filed Oct. 14, 2011.

BACKGROUND OF THE PRESENT INVENTION

Field of Invention

The present invention relates to a balloon, particularly to a balloon with a lighting/sounding device.

Description of Related Arts

As people's living standards continue to improve, because of its unique decorativeness, balloon has become a choice of life. Typically, people decorate with a single inflated balloon or a combination of multiple balloons.

However, this usage is too monotonous to meet diversified needs. So balloons with various effects have been created, such as the luminous balloon disclosed by the Chinese patent application CN200610122541.7. The luminous balloon has a lighting effect and is characterized in that an LED lamp is taken as a light source and a light circuit device which supplies power to a silicon photocell is arranged in a plastic shell with an air hole. It has a simple frame, and is convenient to use and suitable not only for being held in hand after being sleeve jointed with a plastic pipe but also for being tied and dragged by a rope to float in the air or ornament the night scene.

Nevertheless, although such a balloon structure is capable of emitting light, its illuminant and inflating structure are located at the inlet of the balloon, which makes the balloon difficult to inflate; the balloon is relatively heavy and difficult to launch; there are also problems in production and costs, so the balloon has not been widely used.

The British patent application GB20070004575 has disclosed a structure where a lighting device is fixed to the inner wall of a balloon, wherein the lighting device is provided with an LED lamp at the lower part and a projecting mushroom head at the upper part, an O-ring is tied to the lower part of the mushroom head so that the balloon is closely attached to the lighting device to fix the lighting device to the balloon, a protruding arrow head shape enlargement is provided at the inlet, which is connected to a contact piece on the lighting device, and the LED lamp is turned on by pulling out the arrow head shape enlargement to close the lighting circuit. This structure avoids providing a lighting device at the inlet of a balloon, thereby facilitating inflation of the balloon, and the lighting device may have a small size and be installed within the balloon. But yet it is limited in that: the provision of the mushroom head and the O-ring makes the fixation structure between the balloon and the lighting device monotonous, as the O-ring needs to be provided at the reduced neck portion of the mushroom head in order to fix the balloon to the lighting device; the mushroom head has no other functions than being part of the fixation structure; the reduced neck of the mushroom head requires much more complicated processes and procedures, which increases the manufacture costs; despite its easy control, the arrow head shape enlargement wastes resources and is not conducive to environmental protection.

SUMMARY OF THE PRESENT INVENTION

On the basis of the above problems, a first object of the present invention is to provide a balloon with a lighting/sounding device, which is provided with a lighting/sounding device inside and is easy to control and inflate at lower costs.

A second object of the present invention is to provide a balloon with a lighting/sounding device which is easy to control without affecting inflation of the balloon or producing environmentally unfriendly wastes.

A third object of the present invention is to provide a balloon with a lighting/sounding device, wherein the turn-on and turn-off of the lighting/sounding device is controlled from outside of the balloon so as to conserve resources.

A last but not least object of the invention is to provide a balloon with a lighting/sounding device, wherein a protective structure is provided where the lighting/sounding device contacts the balloon wall, and the protective structure interferes with a motion direction of the lighting/sounding device and lowers a motion speed when the balloon explodes to make sure the lighting/sounding device would cause no harm to human bodies.

To achieve these objects, the present invention is carried out through following technical solutions.

A balloon with a lighting/sounding device comprises a balloon body and a lighting/sounding device secured onto a wall of the balloon body, wherein the lighting/sounding device is secured onto the balloon wall via an external cover.

The balloon is made of latex, aluminum film or other materials.

The lighting/sounding device has a lighting lamp or a sounder, and a battery electrically connected with the lighting lamp or the sounder in various manners, and an outer end of the lighting/sounding device is a fixing portion covered by the balloon, with the external cover being fastened onto the balloon and the fixing portion. Further, the lighting/sounding device is provided with the lighting lamp or the sounder at a front end, at a middle part is provided with button batteries connected to the lighting lamp or the sounder via a contact piece, and at an end portion is provided with the fixing portion covered by the balloon body, with the external cover being fastened onto the fixing portion.

The lighting lamp is one member selected from a group consisting of an incandescent lamp, a neon lamp, and an LED lamp; the sounder, as in the usual sense, is a device capable of playing music or sound, such as a speaker; a capacity, size and number of the button batteries can be preset as needed, and under normal circumstances, 2~4 button batteries are necessary for lighting or sounding needs.

Further, a control switch that controls to turn on or off the lighting/sounding device is provided on the external cover.

Further, the control switch is fixed on a top of the external cover.

Further, the external cover has at least one press portion corresponding to a control switch installed within the lighting/sounding device for closing an electrical connection of the lighting/sounding device to start the lighting/sounding device, the control switch being controlled by pressing of the press portion.

The external cover has a balloon wall inside and the balloon wall has the control switch corresponding to the lighting/sounding device inside; or the balloon wall is positioned below the control switch.

Further, the external cover is covered with a switch base, and the control switch is provided on the switch base and protrudes into the balloon to contact a circuit of the lighting/sounding device, so as to control to turn on or off the lighting/sounding device.

The control switch is one member selected from a group consisting of a touch-pressure switch, a push switch, and a toggle switch.

In a preferred mode, the switch base has a press portion thereon, and the control switch is a trigger mechanism; a lower part of the press portion corresponds to the trigger mechanism, and the trigger mechanism protrudes into the fixing portion of the lighting/sounding device; the contact piece extends to the fixing portion and corresponds to the trigger mechanism, and the contact piece is connected to the button batteries or disconnected from the electrical connection with the button batteries through the trigger mechanism.

Further, the contact piece extends to the fixing portion to form a bent portion projecting in correspondence to the trigger mechanism, and the back of the button batteries is hollow, allowing the bent portion to contact the button batteries to form an electrical connection and start the lighting/sounding device.

The press portion and the trigger mechanism are normally made of non-conductive materials like plastic cement, plastic or rubber, while the contact piece is made of conductive metal materials like nickel-plated sheet metal.

The lighting device is provided within a housing which, for the purpose of enforcing the safety and liability of the lighting device, comprises an upper housing and a lower housing which are secured to each other in order to contain the lighting device and expose the lighting lamp; the upper and lower housings together compose an end portion fitted into the external cover so that the lighting device is tightly fixed to the wall of the balloon body by the external cover.

Considering balloons are apt to explode when inflated, for the sake of safety, a flexible protective membrane is attached to the wall of the balloon body at a position where the lighting/sounding device is fixed on the balloon body, so that, when the balloon explodes, the lighting/sounding device would not scatter at high speed and cause bodily injury.

The protective membrane is generally provided at an interior of the balloon wall, namely inside the balloon. In another embodiment, an exterior of the balloon wall is attached with an additional protective membrane.

The protective membrane is one member selected from a group consisting of paper sheet, adhesive sticker/paper, preservative film, flexible plastic film, bubble gum, and cloth.

The protective membrane covers an area larger than an area occupied by the lighting/sounding device to achieve better protection.

In the case where the protective membrane is to be provided outside of the balloon wall, a preferred mode is to enclose an adhesive sticker/paper for a user to attach to the balloon wall surrounding the lighting/sounding device after inflating the balloon for enhanced protection.

The protective membrane can be provided inside and outside the balloon wall at the same time.

On condition that a balloon of the prior art is not affected, the present invention fixes the lighting/sounding device via the external cover, which facilitates the setting and installation of the lighting/sounding device and simplifies the configuration structure thereof so as to reduce the manufacturing costs, and such a structure doesn't affect the inflation and use of the balloon but provides more convenient decoration and entertainment.

This structure further enables control of the lighting/sounding device, because what is needed to turn on or off the lighting/sounding device is a simple press, instead of control by an additional component attached at the inlet of the balloon. Also, it helps to conserve more resources and avoid pollution and adverse effects on the environment.

DETAILED DESCRIPTION OF THE PREFERRED EMBODIMENT

To explain the objects, technical solutions and advantages of this invention in a clearer way, here is a detailed description with reference to the drawings and the embodiments. It is to be understood that any embodiment described herein is intended to be illustrative, without any limitation to the present invention.

Figure 1:
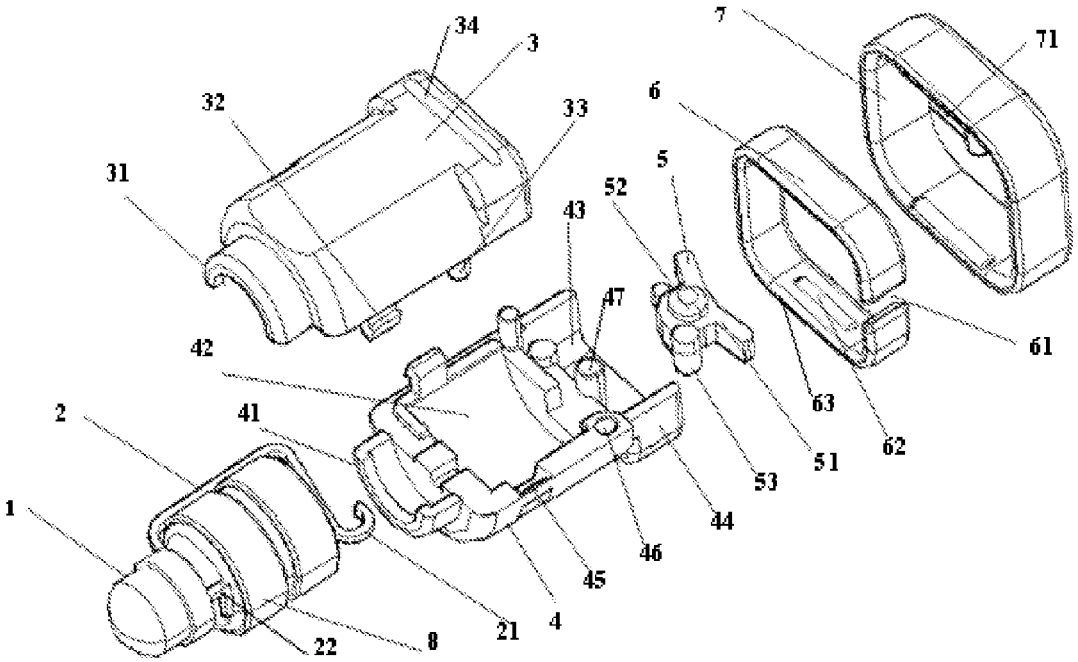
FIG. 1 is an exploded view of a lighting device and an external cover according to a first embodiment of the present invention.

With reference to FIG. 1, in a first embodiment, an exploded diagram is used to show the structure wherein a lighting device is integrated with an external cover; though a depiction of the balloon is thus left out, the balloon is still an integral part of the invention. Since the balloon has the same structure as in the prior art, we will only describe the lighting device and the external cover to explain their structural characteristics.

The lighting device comprises an LED lamp 1, a contact piece 2, an upper housing 3 and a lower housing 4, wherein turn-on of the LED lamp is controlled by a trigger mechanism 5. In this lighting device, upper and lower housings 3 and 4 are fixed to each other. In particular, the upper housing 3 has a projecting block 32 and a projecting post 33 at one side, the lower housing 4 has a clamping slot 45 and a clamping hole 46 respectively corresponding to positions of the projecting block 32 and the projecting post 33, and the projecting block 32 and the projecting post 33 can be nested into the clamping slot 45 and the clamping hole 46 to fix the upper and lower housings 3 and 4; likewise, the lower housing 4 has a projecting block and a projecting post at the other side, the upper housing 3 has a clamping slot and a clamping hole at corresponding positions, and the upper and lower housings 3 and 4 are firmly fixed together as the two buckle at both sides. In this way, the front portion 31 of the upper housing 3 and the front portion 41 of the lower housing 4 form an opening large enough for the LED lamp 1 to come out for lighting.

The LED lamp 1 has two contact pieces 2 and 22 protruding backwards, wherein the contact piece 22 is directly connected to the front of button batteries 8, the contact piece 2 protrudes backwards to the back of the button batteries 8 and forms a bent portion 21, and the bent portion 21 formed by the protruding rear end of the contact piece 2 completes a circuit with the button batteries 8 to supply power to the LED lamp 1.

The button batteries 8 are installed within a central cavity 42 formed between the upper housing 3 and the lower housing 4, the central cavity 42 communicates with a rear cavity 43 formed by the back of the upper and lower housings 3 and 4, and thereby a circuit is completed by a trigger mechanism 5 pressing the bent portion 21 of the contact piece 2 to control turn on and off of the LED lamp 1.

The trigger mechanism 5 has a pivot sleeve 52 at the middle part, the pivot sleeve 52 being sleeved on a projecting shaft 47 within the rear cavity 43 in such a way that the trigger mechanism 5 is able to swing around the projecting shaft 47; a contact pressure portion 51 extends from each side of the trigger mechanism 5, and a protruding top holding portion 53 is provided at the lower part of the trigger mechanism 5; pressing one of the contact pressure portions 51 of the trigger mechanism 5 causes the top holding portion 53 to push the bent portion 21 or to release the bent portion 21 from depression so as to control to turn on or off the LED lamp.

The lower housing 4 has a buckling portion at the end portion 44, and the upper housing also has a buckling portion 34 at the end portion; an external cover 6 is nested into the buckling portion 34 via a buckling slot 62 to tightly integrate the lighting device with the balloon body. To facilitate assembly of the external cover 6, a gap 61 is usually provided at one side thereof.

To make the control of turn-on and turn-off of the LED lamp 1 more convenient, a switch cover 7 is further provided. The switch cover 7 is buckled to the bottom edge 63 of the external cover 6 and firmly fixes the lighting device onto the wall of the balloon body together with the external cover 6. A press portion 71 is provided on the top of the switch cover 7 for a user to control the trigger mechanism 5.

Figure 2:
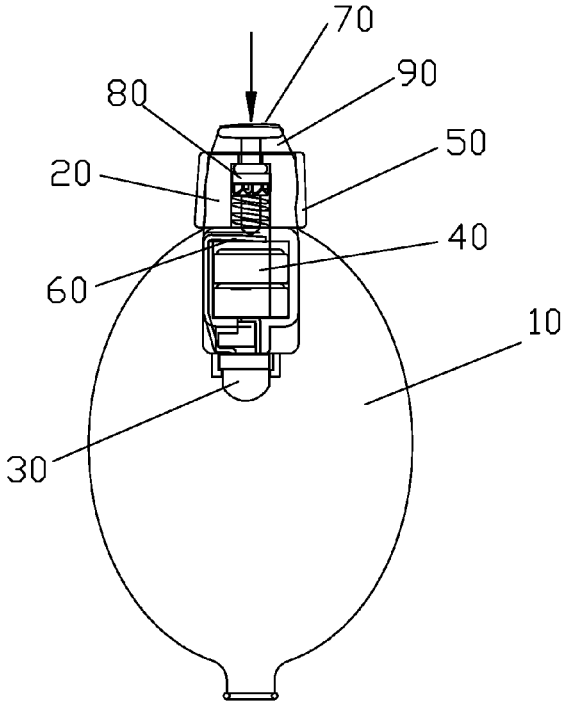
FIG. 2 is a sketch view of a balloon with a lighting/sounding device according to a second embodiment of the present invention.

FIG. 2 shows a simplified diagram of a second embodiment of the present invention. In the second embodiment, an LED lamp 30 and button batteries 40 are installed within a housing of a lighting device, a contact piece 60 protrudes to the back of the button batteries 40, the housing of the lighting device extends outward to form an end portion 20 of the lighting device, which further extends outward to form a switch base 90, and a press portion 70 is positioned on the surface of the switch base 90, pressing of which would push the trigger mechanism 80 to advance.

An external cover 50 fixes the lighting device onto the wall of a balloon body 10 and positions the LED lamp 30 inside the balloon.

Figure 3:
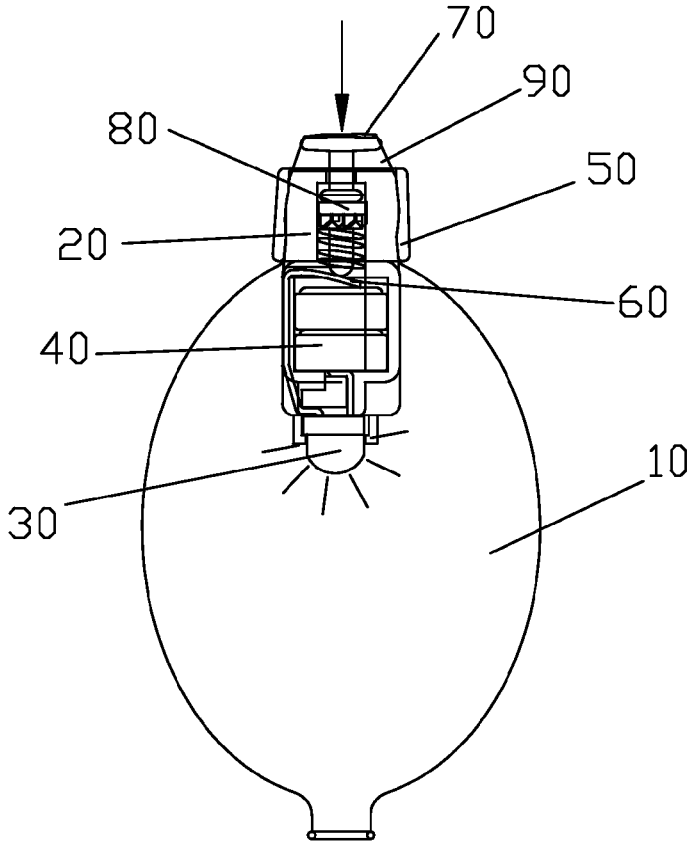
FIG. 3 is a sketch view of the lighting device of FIG. 2.

With reference to FIG. 3, the press portion 70 is contacted and pressed in the direction of the arrow to push the trigger mechanism 80 to move downward so that the contact piece 60 is held above the button batteries 40 to close the circuit and turn on the LED lamp 30.

Figure 4:
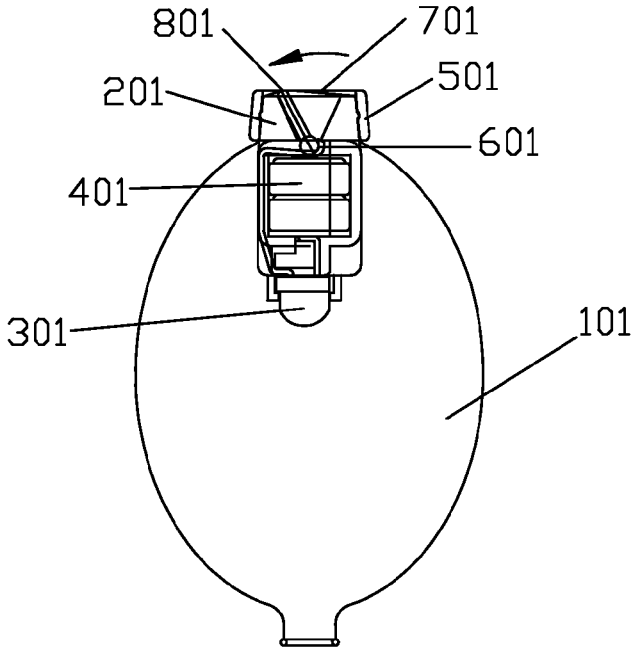
FIG. 4 is a sketch view of the balloon with the lighting/sounding device according to a third embodiment of the present invention.
Figure 5:
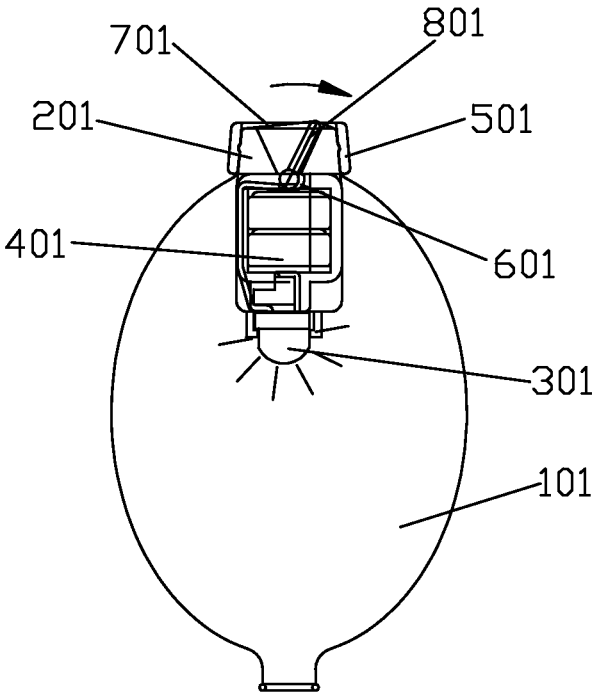
FIG. 5 is a sketch view of the lighting device of FIG. 4.

In the second embodiment, an integrated structure is formed by the switch base 90 and the end portion 20 of the lighting device, which may be further simplified in a third embodiment as showed in FIGS. 4 and 5 by omitting the switch base.

FIG. 4 shows a simplified diagram of the third embodiment of the present invention. In the third embodiment, an LED lamp 301 and button batteries 401 are installed within a housing of a lighting device, a contact piece 601 protrudes to the back of the button batteries 401, and the housing of the lighting device extends outward to form an end portion 201 of the lighting device.

A press portion 701 is positioned on the surface of an external cover 501, and pressing of the press portion 701 strikes a trigger mechanism 801 which is a toggle switch positioned inside the end portion 201. The trigger mechanism 801, when stricken in the direction of the arrow, brings the contact piece 601 into contact with the button batteries 401.

An external cover 501 fixes the lighting device onto the wall of a balloon body 101 and positions the LED lamp 301 inside the balloon.

With reference to FIG. 5, the press portion 701 strikes in the direction of the arrow the trigger mechanism 801 to make it turn right, and the bottom of the trigger mechanism 801 presses the contact piece 601 so that the contact piece 601 is held above the button batteries 401 to close the circuit and turn on the LED lamp 301.

Figure 6:
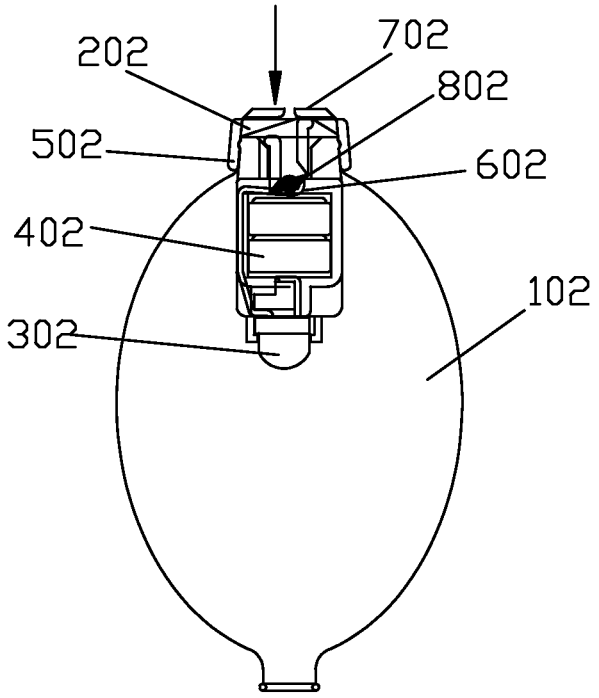
FIG. 6 is a sketch view of the balloon with the lighting/sounding device according to a fourth embodiment of the present invention.

FIG. 6 shows a simplified diagram of a fourth embodiment of the present invention, which has the same fundamental structure as showed in FIG. 4 but differs in the configuration of press portion and trigger mechanism. In the fourth embodiment, an LED lamp 302 and button batteries 402 are installed within a housing of a lighting device, a contact piece 602 protrudes to the back of the button batteries 402 and forms a bent portion at the back of the button batteries 402 for pressing a trigger mechanism 802; the housing of the lighting device extends outward to form an end portion 202 of the lighting device.

Two of the left and right press portions 702 are positioned on the surface of an external cover 502, which can press the trigger mechanism 802 from right and left, and the trigger mechanism 802 is positioned at the inner side of the end portion 202, which can swing to bring the contact piece 602 into contact with the button batteries 402.

An external cover 502 fixes the lighting device onto the wall of a balloon body 102 and positions the LED lamp 302 inside the balloon.

Figure 7:
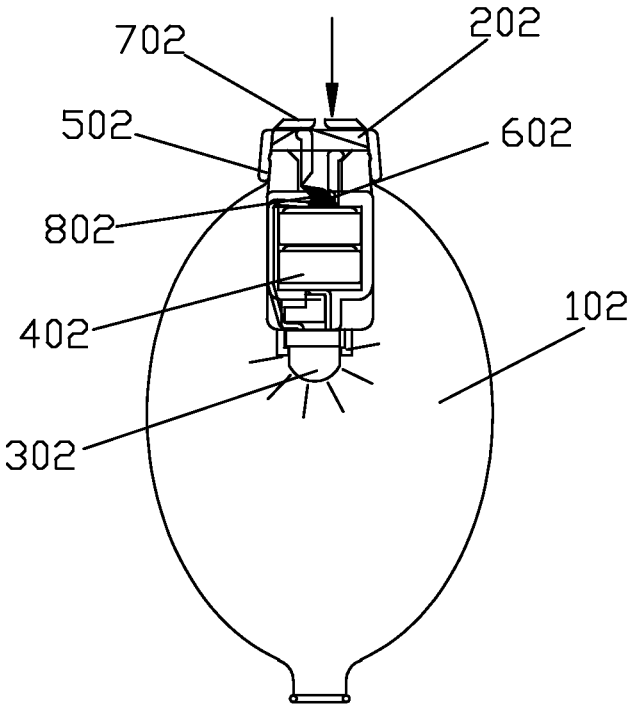
FIG. 7 is a sketch view of the lighting device of FIG. 6.

With reference to FIG. 7, one of the press portions 702 strikes the trigger mechanism 802 in the direction of the arrow to make it turn right, and the trigger mechanism 802 presses the contact piece 602 so that the contact piece 602 is held above the button batteries 402 to close the circuit and turn on the LED lamp 302.

Figure 8:
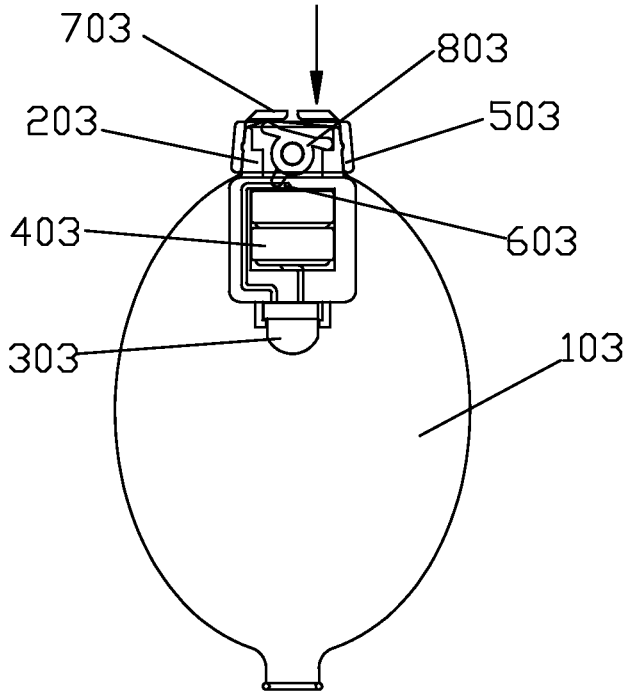
FIG. 8 is a sketch view of the balloon with the lighting/sounding device according to a fifth embodiment of the present invention.

FIG. 8 shows a simplified diagram of a fifth embodiment of the present invention. In the fifth embodiment, an LED lamp 303 and button batteries 403 are also installed within a housing of a lighting device, a contact piece 603 protrudes to the back of the button batteries 403, and the housing of the lighting device extends outward to form an end portion 203 of the lighting device.

Two of the left and right press portions 703 are positioned on the surface of an external cover 503, which can press a trigger mechanism 803 from right and left, and the trigger mechanism 803 is a toggle switch positioned inside of the end portion 203 that can be stricken to left or right to bring the contact piece 603 into contact with the button batteries 403.

An external cover 503 fixes the lighting device onto the wall of a balloon body 103 and positions the LED lamp 303 inside the balloon.

Figure 9:
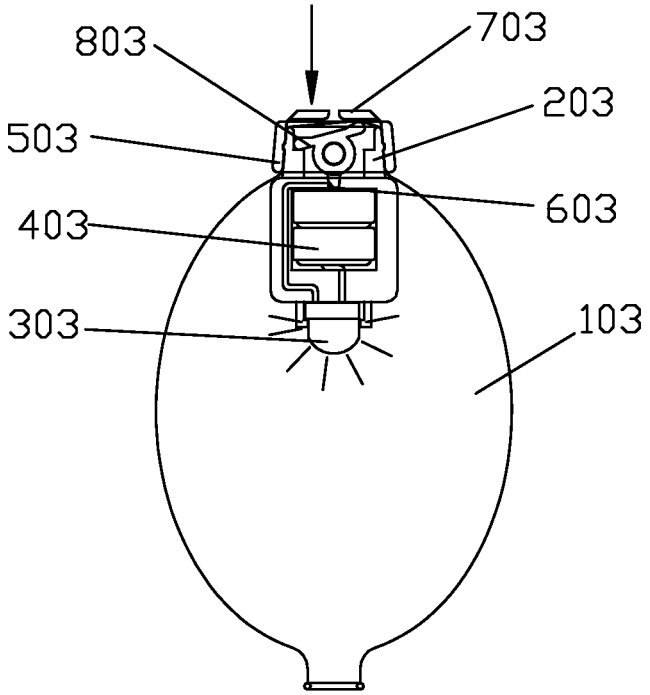
FIG. 9 is a sketch view of the lighting device of FIG. 8.

With reference to FIG. 9, one of the press portions 703 is contacted and pressed in the direction of the arrow to press the trigger mechanism 803 to turn, and the bottom of the trigger mechanism 803 presses the contact piece 603 so that the contact piece 603 is held above the button batteries 403 to close the circuit and turn on the LED lamp 303. To turn off the LED lamp 303, the other press portion 703 needs to be contacted and pressed.

Figure 10:
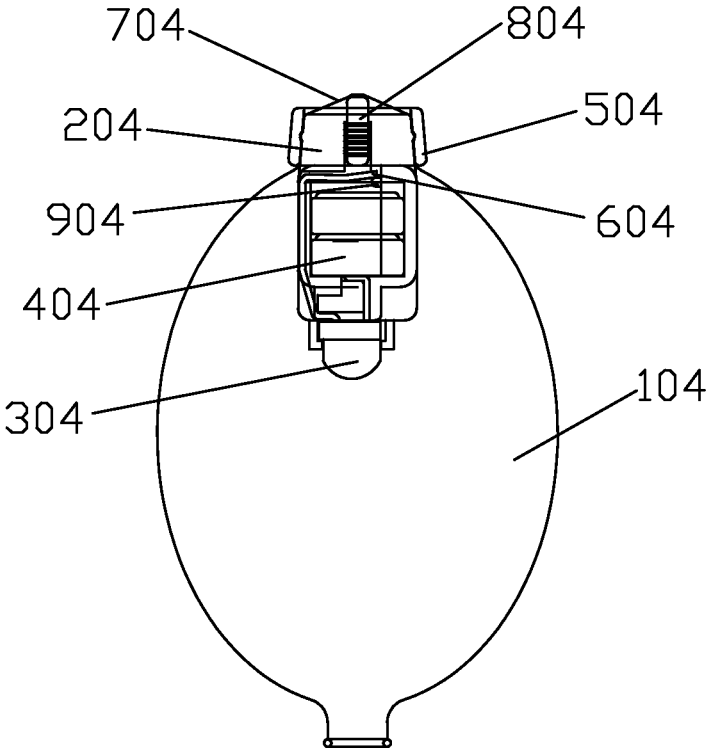
FIG. 10 is a sketch view of the balloon with the lighting/sounding device according to a sixth embodiment of the present invention.

FIG. 10 shows a simplified diagram of a sixth embodiment of the present invention. In the sixth embodiment, an LED lamp 304 that is always on once activated for use with disposable balloons and button batteries 404 are installed within a housing of a lighting device, a contact piece 604 protrudes to the back of the button batteries 404, and the housing of the lighting device extends outward to form an end portion 204 of the lighting device.

A projecting clamping block 904 is provided corresponding to a position where the contact piece 604 closes the circuit; when the contact piece 604 is held on the button batteries 404 after pressed down by a trigger mechanism 804, the clamping block clamps the contact piece 604 to make it stably close the circuit and stay in contact with the button batteries 404. The trigger mechanism 804 has a plurality of barbs itself to stably advance when pressed.

A press portion 704 is positioned on the surface of an external cover 504, by which the trigger mechanism 804 positioned inside an end portion 204 is contacted and pressed.

The external cover 504 fixes the lighting device onto the wall of a balloon body 104 and positions the LED lamp 304 inside the balloon.

Figure 11:
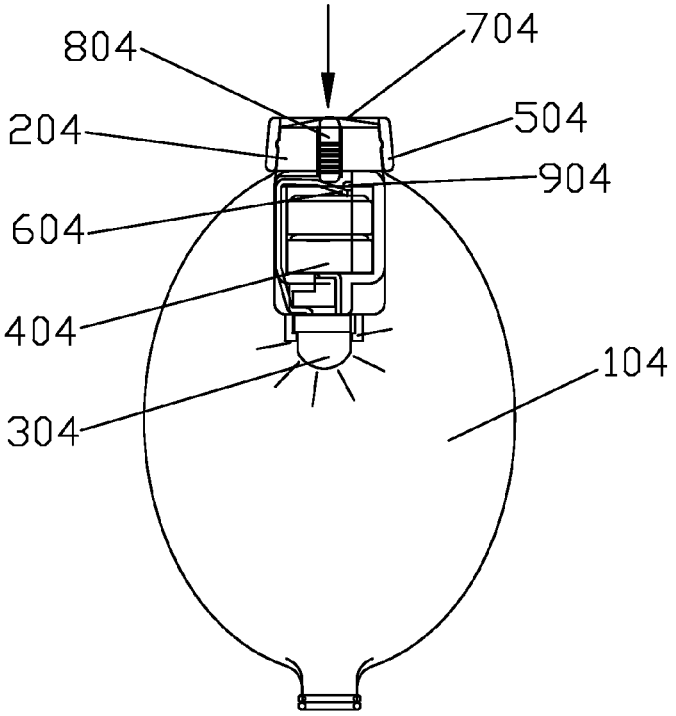
FIG. 11 is a sketch view of the lighting device of FIG. 10.

With reference to FIG. 11, the press portions 704 is contacted and pressed in the direction of the arrow to press the trigger mechanism 804 to move downward, and the trigger mechanism 804 presses the contact piece 604 so that the contact piece 604 is held above the button batteries 404 to close the circuit and turn on the LED lamp 304. Meanwhile, the clamping block 904 clamps the contact piece 604 to make it stably close the circuit and stay in contact with the button batteries 404.

Figure 12:
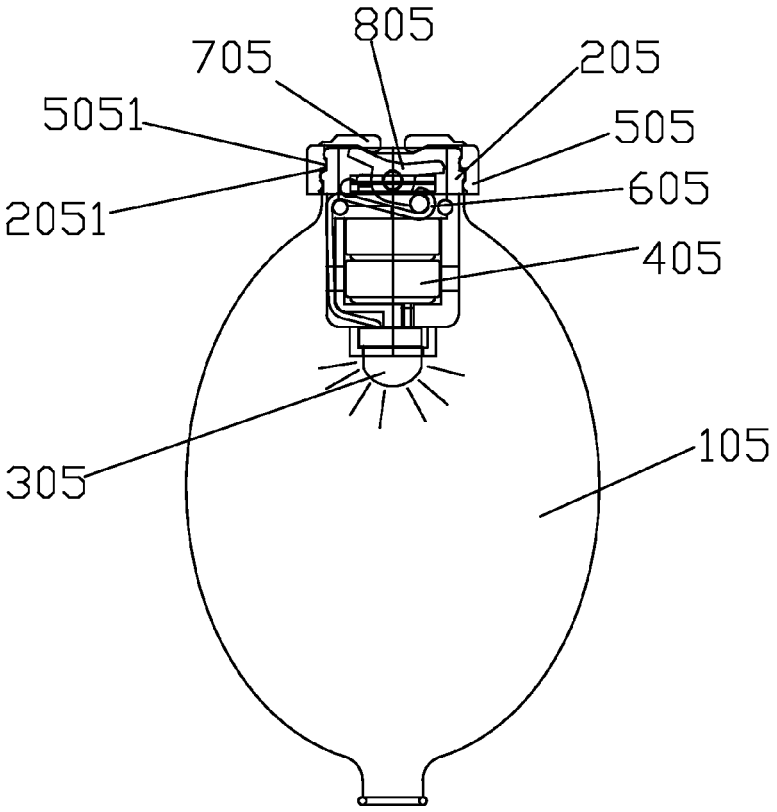
FIG. 12 is a sketch view of the balloon with the lighting/sounding device according to a seventh embodiment of the present invention.

FIG. 12 shows a simplified diagram of a seventh embodiment of the present invention. In the seventh embodiment, an LED lamp 305 and button batteries 405 are installed within a housing of a lighting device, a contact piece 605 protrudes to the back of the button batteries 405, and the housing of the lighting device extends outward to form an end portion 205 of the lighting device.

Two of the left and right press portions 705 are positioned on the surface of an external cover 505, which can press a trigger mechanism 805 from right and left, and the trigger mechanism 805 is a toggle switch positioned inside of the end portion 205 that can be stricken to left or right to hold the contact piece 605 into contact with the button batteries 405.

The external cover 505 fixes the lighting device onto the wall of a balloon body 105 and positions the LED lamp 305 inside the balloon. The external cover 505 has a thread 5051 projecting inward at the inner side, and the end portion 205 has a thread groove 2051 at a corresponding position; the thread 5051 can be nested into the thread groove 2051, and thereby the external cover 505 can be firmly integrated with the end portion 205 by rotating the external cover 505 for installation.

One of the press portions 705 is contacted and pressed to press the trigger mechanism 805 to turn, and the bottom of the trigger mechanism 805 presses the contact piece 605 so that the contact piece 603 is held above the button batteries 405 to close the circuit and turn on the LED lamp 305. To turn off the LED lamp 305, the other press portion 7053 needs to be contacted and pressed.

To conclude, a primary structural improvement of the present invention is to provide an external cover via which a balloon is directly secured onto a lighting device (or other devices like a sounding device), so that the wall of the balloon body is positioned between the external cover and the lighting device and the process of necking is no longer needed for the lighting device. The external cover and the lighting device can be fixed together by buckling (e.g. buttoning), screwing, welding (e.g. ultrasonic welding), interference fit and the like. Further, the external cover may make use of an attached control switch to control the lighting device.

The foregoing is only a description of preferred embodiments of the present invention, and is not intended to limit the invention in any way. Any modification, equivalent replacement or improvement made without departing from the spirit and scope of the invention is covered under the protection scope claimed therein.

What is claimed is:

1. A balloon with a lighting/sounding device, comprising a lighting/sounding device which is fixed within a balloon wall and is secured onto the balloon wall via an external cover, wherein the lighting/sounding device has a lighting lamp or a sounder, and a battery, and an outer end of the lighting/sounding device is a fixed portion covered by the balloon, with the external cover being fastened onto the balloon and the fixed portion, wherein a control switch is provided on the external cover;

wherein the lighting/sounding device further comprises an upper housing and a lower housing, wherein the upper and lower housings are fixed to each other; the battery is installed within a central cavity formed between the upper housing and the lower housing; the central cavity communicates with a rear cavity formed by backs of the upper housing and the lower housings; and the lighting lamp or the sounder has two contact pieces protruding backwards, wherein a first contact piece is directly connected to a front of the battery; a second contact piece protrudes backwards to a back of the battery and forms a bent portion; and the bent portion formed by a protruding rear end of the second contact piece is for completing a circuit with the battery to supply power to the lighting lamp or the sounder; the contact pieces are made of conductive metal materials;

further comprising a trigger mechanism which has a pivot sleeve at a middle part, the pivot sleeve being sleeved on a projecting shaft within the rear cavity, in such a way that the trigger mechanism is able to swing around the projecting shaft, wherein:

a contact pressure portion respectively extends from each side of the trigger mechanism, and a protruding top holding portion is provided at a lower part of the trigger mechanism; pressing one of the contact pressure portions of the trigger mechanism causes the top holding portion to push the bent portion or to release the bent portion from depression, so as to control to turn on or off the lighting lamp or the sounder; the second contact piece is connected to the battery or disconnected from an electrical connection with the battery through the trigger mechanism; the trigger mechanism is made of non-conductive materials; and further comprising a switch cover which is buckled to a bottom edge of the external cover and firmly fixes the lighting/sounding device onto the balloon wall together with the external cover, wherein a press portion is provided on a top of the switch cover for a user to control the trigger mechanism; the press portion is made of non-conductive materials.

2. The balloon with a lighting/sounding device according to claim 1, wherein the press portion is pressed to push the trigger mechanism to move downward so that the contact piece is held above the battery to close the circuit and turn on the lighting lamp or the sounder.

3. The balloon with a lighting/sounding device according to claim 2, further comprising a flexible protective membrane which is attached to the balloon wall at a position where the lighting/sounding device is fixed on a balloon body of the balloon, for preventing the lighting/sounding device from scattering and causing bodily injury when the balloon explodes; the protective membrane is provided at an interior of the balloon wall.

4. The balloon with a lighting/sounding device according to claim 3, wherein the protective membrane is one member selected from a group consisting of paper sheet, adhesive sticker/paper, preservative film, flexible plastic film, bubble gum and cloth, and the protective membrane covers an area larger than an area occupied by the lighting/sounding device.

* * * * *